US005327631A

United States Patent [19]

Lincavage

[11] Patent Number: 5,327,631

[45] Date of Patent: Jul. 12, 1994

[54] ROLL PIN PUNCH KIT APPARATUS

[76] Inventor: George P. Lincavage, 3711 Remington Ave., Pennsauken, N.J. 08110

[21] Appl. No.: 905,466

[22] Filed: Jun. 29, 1992

[51] Int. Cl.[5] ..... B25B 27/02

[52] U.S. Cl. ..... 29/271; 29/275; 30/358; 279/46.2

[58] Field of Search ..... 29/254, 255, 275, 271; 30/358, 366, 367, 368; 279/2.17, 46.2

[56] References Cited

U.S. PATENT DOCUMENTS

| | | | |
|---|---|---|---|
| 1,761,207 | 6/1930 | Guertin | 30/358 |
| 2,285,956 | 6/1942 | Weber | 279/46.2 X |
| 2,365,425 | 12/1944 | Miller | 29/275 |
| 2,484,027 | 10/1949 | Haffey | 279/46.2 X |
| 2,815,692 | 12/1957 | Daniels | 29/275 X |
| 2,869,883 | 1/1959 | Dunbar | 279/46.2 X |
| 3,099,876 | 8/1963 | Lawless | 29/275 X |
| 3,349,652 | 10/1967 | Cromwell | 29/271 X |

FOREIGN PATENT DOCUMENTS

| | | | |
|---|---|---|---|
| 872906 | 7/1961 | United Kingdom | 30/358 |

*Primary Examiner*—Eugenia Jones
*Assistant Examiner*—Raymond D. Woods
*Attorney, Agent, or Firm*—Leon Gilden

[57] ABSTRACT

A plurality of roll pin punches in association with an elongate handle are mounted for ease of assembly within a container structure. A cap member having an internally threaded bore and including a forward wall bore coaxially aligned through the forward wall and the threaded bore includes a resilient "O" ring mounted within a toroidal groove and interfaced between the threaded bore and the forward wall bore to secure the punch member.

2 Claims, 4 Drawing Sheets

ROLL PIN PUNCH KIT APPARATUS

BACKGROUND OF THE INVENTION

1. Field of the Invention

The field of invention relates to roll pin punch structure, and more particularly pertains to a new and improved roll pin punch kit apparatus wherein the same is arranged to accommodate roll pins of various sizes.

2. Description of the Prior Art

Punches of various types for various applications are utilized throughout the prior art such as exemplified in U.S. Pat. No. 4,960,235 to Gregory wherein a nail set structure includes a bore arranged to receive a nail member therewithin for impacting the nail and its projection into an associated workpiece.

The U.S. Pat. No. 4,834,342 to Padgett sets forth a further example of a nail pin driver.

U.S. Pat. No. 3,879,848 to Murphy sets forth an example of a multiple center punch tool having punches of various sizes radially mounted about a central support body.

As such, it may be appreciated that there continues to be a need for a new and improved roll pin punch kit apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of punch apparatus now present in the prior art, the present invention provides a roll pin punch kit apparatus wherein the same is directed to the mounting of one of a plurality of punches within a handle structure. As such, the general purpose of the present invention, which will be described subsequently in greater detail, is to provide a new and improved roll pin punch kit apparatus which has all the advantages of the prior art punch apparatus and none of the disadvantages.

To attain this, the present invention provides a plurality of roll pin punches in association with an elongate handle mounted for ease of assembly within a container structure. A cap member having internally threaded bore and including a forward wall bore coaxially aligned through the forward wall and the threaded bore includes a resilient "O" ring mounted within a toroidal groove and interfaced between the threaded bore and the forward wall bore to secure the punch member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved roll pin punch kit apparatus which has all the advantages of the prior art punch apparatus and none of the disadvantages.

It is another object of the present invention to provide a new and improved roll pin punch kit apparatus which may be easily and efficiently manufactured and marketed.

It is a further object of the present invention to provide a new and improved roll pin punch kit apparatus which is of a durable and reliable construction.

An even further object of the present invention is to provide a new and improved roll pin punch kit apparatus which is susceptible of a low cost of manufacture with regard to both materials and labor, and which accordingly is then susceptible of low prices of sale to the consuming public, thereby making such roll pin punch kit apparatus economically available to the buying public.

Still yet another object of the present invention is to provide a new and improved roll pin punch kit apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
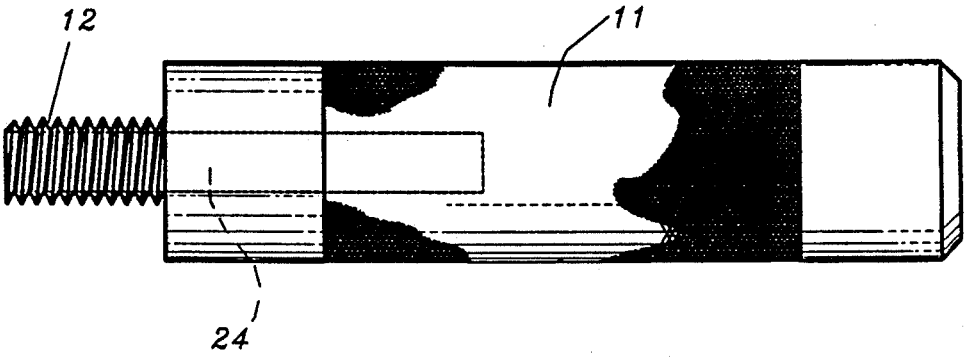
FIG. 1 is an orthographic side view of the handle structure.
Figure 2:
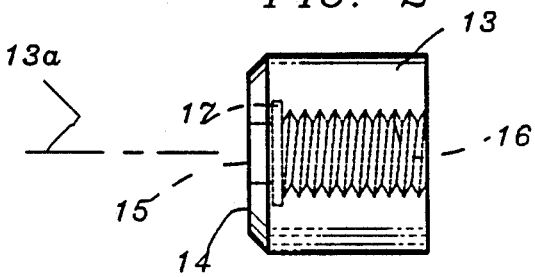
FIG. 2 is an orthographic side view of the cap member structure.
Figure 3:
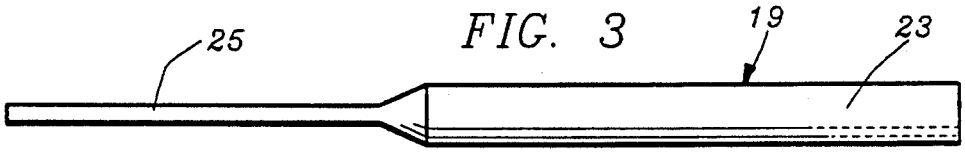
FIGS. 3, 4, 5, and 6 are orthographic side views of variously configured punches for utilization by the kit structure.
Figure 4:
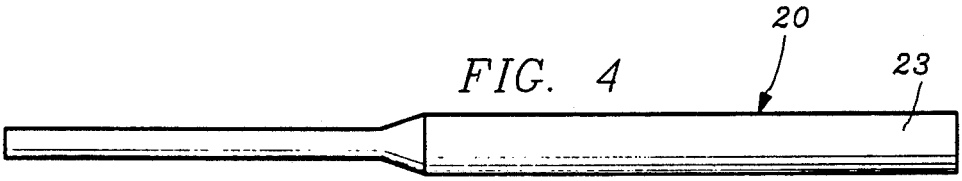
Figure 5:
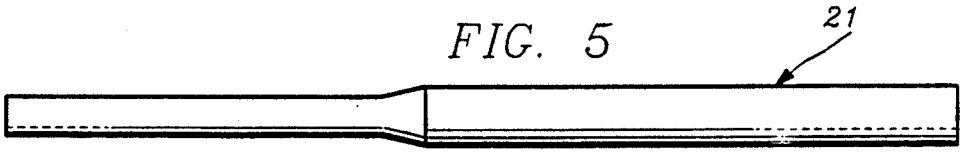
Figure 6:
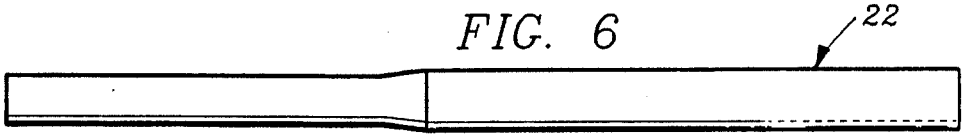
Figure 7:
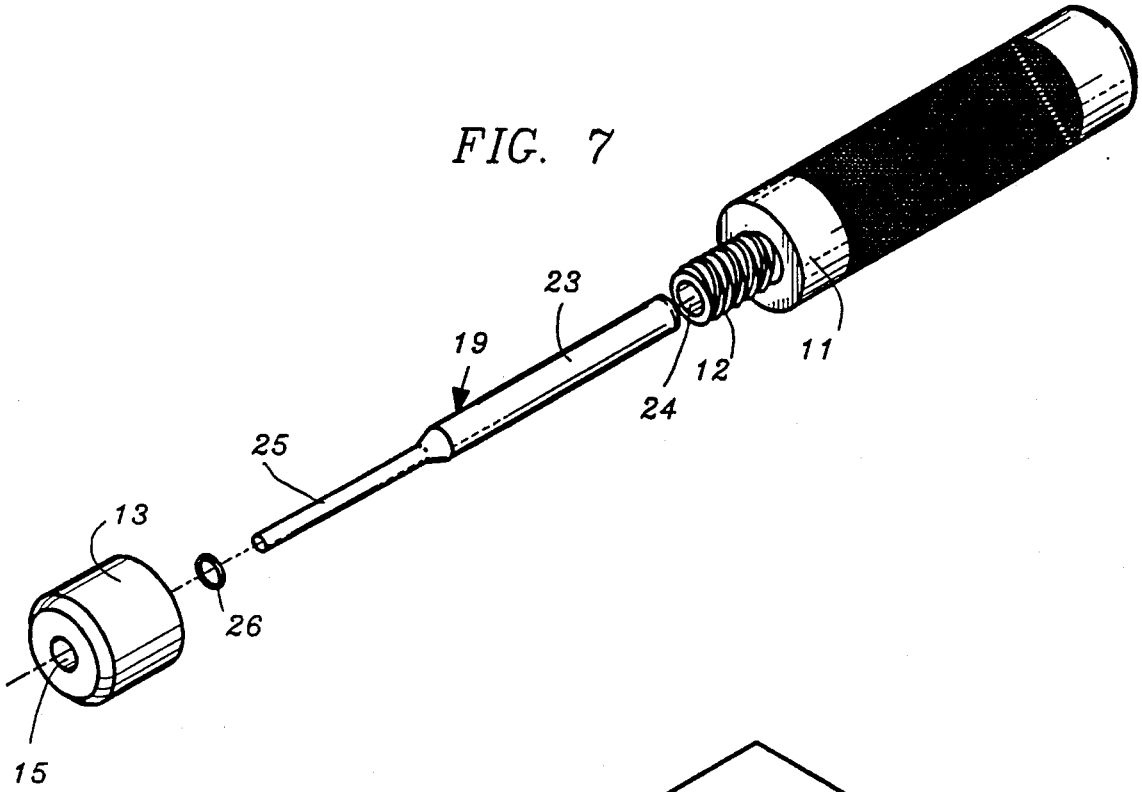
FIG. 7 is an isometric exploded illustration of various components of the organization arranged for assembly relative to one another.

With reference now to the drawings, and in particular to FIGS. 1 to 15 thereof, a new and improved roll pin punch kit apparatus embodying the principles and concepts of the present invention and generally designated by the reference numeral 10 will be described.

More specifically, the roll pin punch kit apparatus 10 of the instant invention essentially comprises the use of an elongate cylindrical handle 11 defined by a predetermined handle diameter having an externally threaded shank 12 coaxially aligned relative to the handle 11 extending forwardly of a forward end wall of the handle. A cylindrical cap member 13 defined by a cap diameter equal to the handle diameter includes a cap member forward wall 14, including a cap member cylindrical forward wall bore 15 extending into the cap member coaxially therewith through the forward wall 14 coaxially and in communication with an internally threaded counter bore 16 directed from the forward wall bore 15 coextensively through the cap member 13. A toroidal groove 17 formed at an interface between the counter bore 16 and the forward wall bore 15 includes a groove diameter greater than a forward wail bore diameter and counter bore diameter of the counter bore 16. The toroidal groove 17, the counter bore 16, and the forward wall bore 15 are coaxially aligned relative to one another and to a cap axis 13*a* of the cap 13.

A plurality of punches to include a first through fourth punch member 19–22 inclusively are each formed with a punch shank 23 defined by an equal shank diameter substantially equal to a shank bore 24 that extends coextensively through the externally threaded shank 12 into and in coaxial alignment with the handle 11, in a manner as illustrated in FIG. 1. Upon tightening the cap member 13 about the shank 12, the resilient "O" ring 26 (see FIG. 7) received within the toroidal groove 17 is compressed and secures an associated shank of one of the punches 19–22 within the handle 11.

Figure 8:
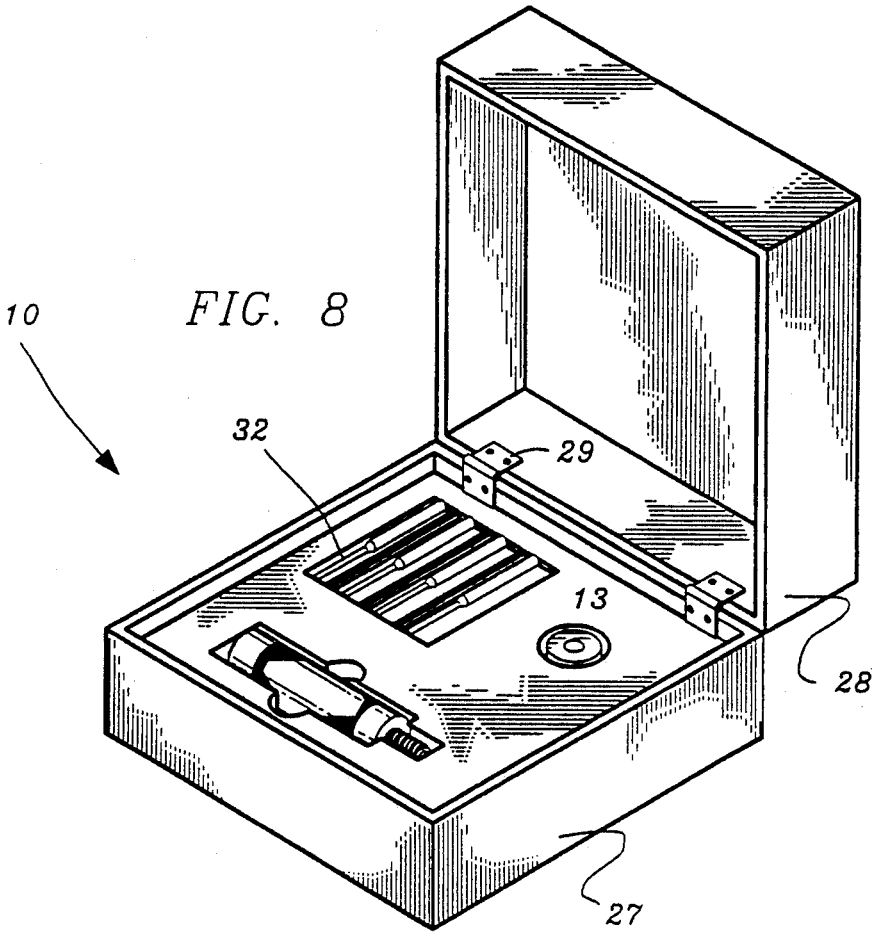
FIG. 8 is an isometric illustration of the kit structure.

The FIG. 8 illustrates the use of a container 27 having a container lid 28 hingedly mounted about a plurality of hinges 29 to the container 27. A first cavity receives the handle 11 therewithin, wherein a second cavity receives a cap member 13. A plurality of third cavities 32 receive the punches 19–22 therewithin, wherein accordingly a predetermined number of such third cavities 32 are arranged with a predetermined number of the punches 19–22 utilized. It may be understood that a greater or lesser number of such punch members 19–22 may be utilized to provide for shank cylindrical projections 25 of various diameters to accommodate variously sized roll pins "R" (see FIG. 9) to be directed into an associated work member "W".

Figure 9:
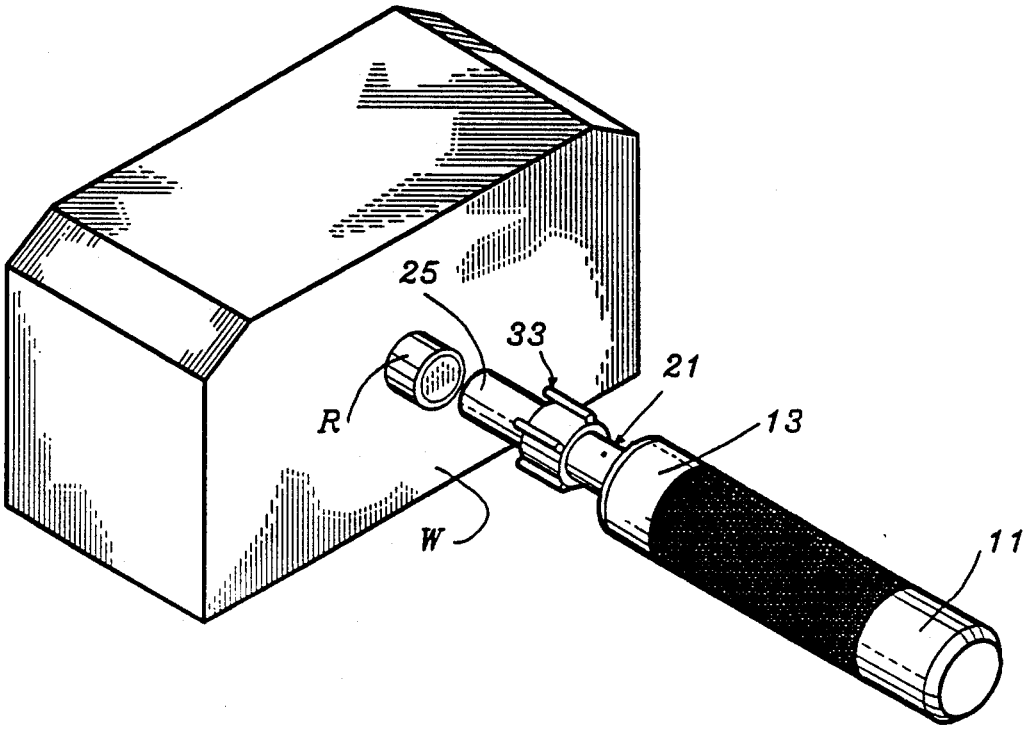
FIG. 9 is an isometric illustration of an alignment sleeve for use by the invention.
Figure 10:
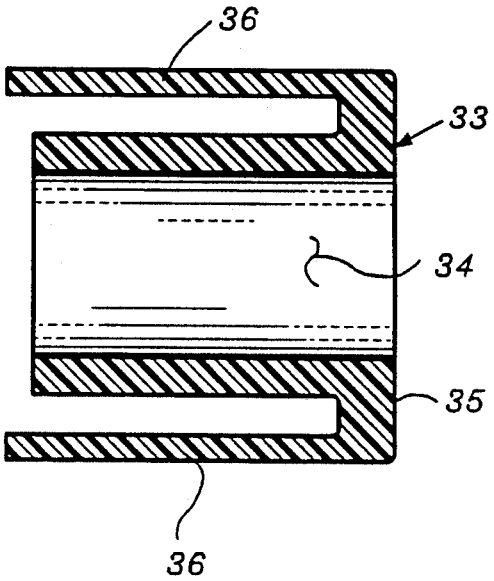
FIG. 10 is an orthographic cross-sectional illustration of the alignment structure as set forth in FIG. 9.
Figure 11:
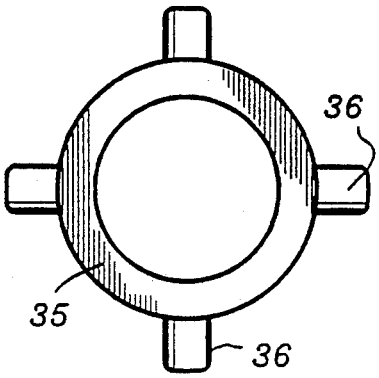
FIG. 11 is an orthographic end view of the alignment sleeve structure.
Figure 12:
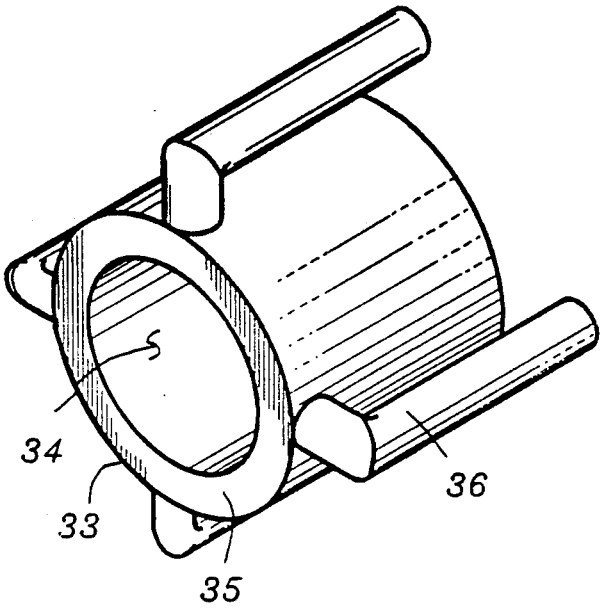
FIG. 12 is an isometric illustration of the alignment sleeve structure.

The FIG. 9 further illustrates the use of a tubular alignment sleeve 33 that may be employed by the invention, wherein each alignment sleeve includes a sleeve bore 34 substantially equal to a shank cylindrical projection diameter of an associated cylindrical shank 25. A tubular alignment sleeve 33 includes a sleeve rear wall 35, including a plurality of leg members 36 extending from the rear wall 35, wherein the leg members are spaced in a parallel relationship relative to the cylindrical side wall of the alignment sleeve 33 and to an axis of the sleeve bore 34. The leg members 36 are arranged for a surrounding relationship relative to a roll pin "R" to position a roll pin prior to and during impact.

Figure 13:
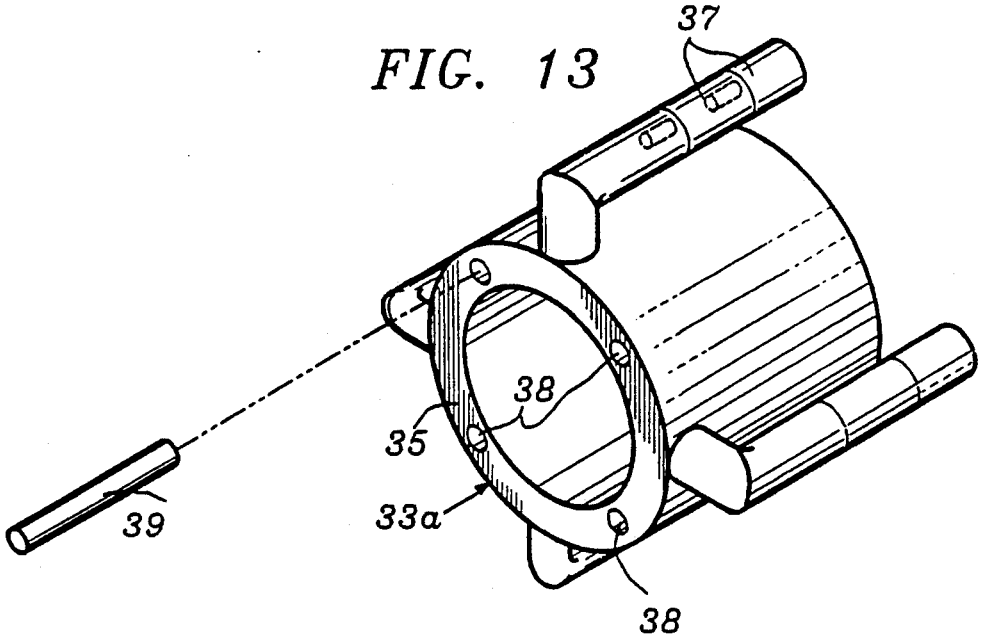
FIG. 13 is an isometric illustration of a modified alignment sleeve structure.
Figure 14:
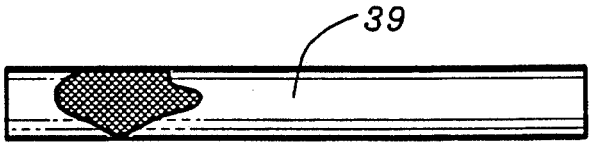
FIG. 14 is an orthographic side view of a magnet member for use by the alignment sleeve structure as set forth in FIG. 13.
Figure 15:
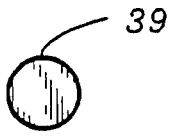
FIG. 15 is an orthographic end view of the magnet member as set forth in FIG. 14.

The FIG. 13 illustrates a modified alignment sleeve 33*a* having a plurality of magnet receiving bores 38 directed through the sleeve rear wall 35, wherein each magnet receiving bore 38 is arranged to receive a magnet bar 39 complementarily therewithin to enhance securement of the sleeve relative to an associated shank 25. Further, the leg members 36 may be formed of leg member segments 37, each threadedly received in a coaxially aligned relationship relative to one another. It should be noted that optionally the leg members are defined by a leg length greater than the predetermined length of the associated sleeve bore 34 to extend beyond the sleeve bore in the alignment and abutment of the leg members relative to a workpiece "W" in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roll pin punch kit apparatus, comprising, an elongate cylindrical handle, the cylindrical handle having a predetermined handle diameter, and the handle including a handle forward wall, and an externally threaded shank coaxially aligned relative to the cylindrical handle and extending from and beyond the handle forward wall, and a plurality of punch members, each punch member including a punch shank defined by a shank diameter received through the externally threaded shank within the handle, and a cap member threadedly receiving the externally threaded shank therewithin for securement of the punch shank within the handle, and the externally threaded shank includes a shank bore directed coextensively through the externally threaded shank and extending into the handle coaxially aligned with the externally threaded shank and the handle, with the externally threaded shank bore defined by said shank diameter to complementarily receive the punch shank therewithin, and the cap member includes a cap member forward wall, the cap member forward wall including a cylindrical forward wall bore defined by a forward wall bore diameter substantially equal to the shank diameter, and an internally threaded counter bore coaxially aligned and intersecting the forward wall bore extending from the forward wall bore coextensively through the cap member, and a toroidal groove defined by a groove diameter greater than the shank diameter at an interface between the forward wall bore and the internally threaded counter bore, wherein the internally threaded counter bore, the forward wall bore, and the toroidal groove are coaxially aligned relative to the cap member, and a resilient "O" ring received within the toroidal groove, and each punch member includes a punch member cylindrical projection extending coaxially of and forwardly of the punch shank, and a tubular alignment sleeve arranged for complementarily receiving the cylindrical projection therethrough for alignment of the cylindrical projection relative to a workpiece, and the alignment sleeve includes a sleeve bore coextensively directed through the alignment sleeve equal to a predetermined length and a bore diameter to complementarily receive the cylindrical projection therewithin, and the alignment sleeve including a sleeve rear wall, the sleeve rear wall having a plurality of leg members mounted to the sleeve rear wall extending in a parallel spaced relationship to the alignment sleeve, wherein the leg members are defined by a leg length greater than the predetermined length of the sleeve bore, and each leg member includes a plurality of segments, the segments are arranged for threaded inter-engagement relative to one another in a coaxially aligned relationship.

2. An apparatus as set forth in claim 1 wherein the sleeve rear wall includes a plurality of magnet receiving bores directed into the alignment sleeve through the sleeve rear wall, and at least one magnet bar, the at least one magnet bar arranged for reception within one of said magnet receiving bores for enhanced securement of the alignment sleeve relative to the cylindrical projection.

* * * * *